United States Patent [19]

Thumm

[11] 4,333,676

[45] Jun. 8, 1982

[54] ROTATIONAL MECHANISM FOR AN EXCAVATOR GRAB BUCKET

[75] Inventor: Heinz Thumm, Fellbach-Oeffingen, Fed. Rep. of Germany

[73] Assignee: Firma Thumm Ölhydraulische Antriebe GmbH, Fellbach-Oeffingen, Fed. Rep. of Germany

[21] Appl. No.: 237,064

[22] Filed: Feb. 23, 1981

[30] Foreign Application Priority Data

Sep. 2, 1978 [DE] Fed. Rep. of Germany ..... 2838346

[51] Int. Cl.[3] ..... B25B 1/00

[52] U.S. Cl. ..... 294/88; 37/183 R; 294/70; 91/222

[58] Field of Search ..... 37/183 R, 184, 186, 37/187, DIG. 7; 173/152, 163; 294/70, 86 R, 88, 86.4, 86.6, 106; 92/2, 3, 61, 71, 106, 116; 91/436, 222

[56] References Cited

U.S. PATENT DOCUMENTS 3,814,471 6/1974 Loeurderoy ..... 37/183 R X
3,966,249 6/1976 Undqvist ..... 37/183 R
4,005,895 2/1977 Cullings ..... 37/183 R
4,239,273 12/1980 Dodemont et al. ..... 294/88

FOREIGN PATENT DOCUMENTS 1556344 2/1970 Fed. Rep. of Germany ..... 294/88
2343558 2/1974 Fed. Rep. of Germany .... 37/183 R
1634950 1/1978 Fed. Rep. of Germany .... 37/183 R

*Primary Examiner*—E. H. Eickholt
*Attorney, Agent, or Firm*—Toren, McGeady & Stanger

[57] ABSTRACT

A mechanism for rotating the grab bucket of an excavator is formed with a stator having a shaft extending into the bore of a rotor with hydraulic ducts being provided in the stator and the rotor in flow communication with each other for activating the grab bucket by means of a hydraulic drive mechanism externally connected therewith. The ducts in the stator and the rotor are hydraulically connected by circular passages formed on the outer circumference of the stator shaft and shoulders formed in the rotor and the stator operate to have arranged therebetween bearing means on opposite sides of the circular passages which interconnect the ducts between the stator and the rotor.

11 Claims, 3 Drawing Figures

ROTATIONAL MECHANISM FOR AN EXCAVATOR GRAB BUCKET

The present invention relates generally to an excavator and more particularly to a mechanism for effecting rotation of the grab bucket or similar tool of an excavator.

In arrangements of the type to which the present invention relates, the grab bucket of an excavator is generally connected with the boom of the excavator and is actuated for rotation about a generally vertical axis. The mechanism for effecting such rotation usually comprises a stator which may be connected with the excavator boom and a rotor which may be connected with the grab bucket and which is supported at the stator to be rotatable about the approximately vertical axis. The stator is formed with a shaft which extends into a central bore of the rotor and two hydraulic ducts are provided which may be connected with hydraulic lines for actuating the grab bucket. The hydraulic ducts are guided through the stator by means of circular passages in the region of the stator shaft which are sealed with respect to each other and to the exterior of the mechanism, and to the rotor and through the rotor, with two additional hydraulic ducts being provided which extend through the stator and which can be connected, if appropriate, with a driving mechanism acting between the stator and the rotor.

By utilization of such a rotational mechanism, hanging loads may be rotated about a vertical axis. Pressure sealed circular passages are provided to prevent twisting of hydraulic lines during rotation of the grab bucket.

A rotating mechanism of the type to which the present invention relates is known from German Pat. No. 23 38 736 wherein the stator is connected with the cylindrical drum of a hydraulic motor through spherical engagement members or balls. Circular passages are arranged at a separating surface forming a radial friction bearing between the stator shaft and the rotor. Additionally, the rotor is supported by means of an axial roller bearing on a shoulder of the cylindrical drum of the motor. In the bottom region of the motor with the spherical balls there are provided two annular discs in a space between the cylindrical drum and a curved housing which serve at a hanging load as friction bearings, and when the grab bucket is pressed on a foundation, they serve as thrust bearings.

However, in practical experience this type of support has been found to be insufficient, esepcially during operation with heavy loads. Particularly during axial and radial impacts against the excavator bucket, rupture or damage of the stator in the region of the radial frictional bearing tends to occur. The radial frictional bearing also tends to be susceptible to wear with the result that circular passages of the hydraulic lines tend to develop premature leakage. A further disadvantage, which arises particularly in larger buckets, is the relatively great structural height of the grab bucket arrangement, including the turning mechanism. Additionally, a mechanism of this type can only be used as a hydraulic motor.

The present invention is directed toward the task of providing a rotational mechanism of the type described which will ensure operation with limited wear even when very heavy loads are involved. Furthermore, the mechanism of the invention is intended to be capable of being selectively equipped for motor operation or manual operation without extensive effort.

SUMMARY OF THE INVENTION

Briefly, the present invention may be defined as apparatus for actuating a grab bucket of an excavator comprising a stator mounted on the excavator, a rotor having said grab bucket mounted thereon connected with said stator for rotation relative thereto about a rotational axis, a shaft on said stator operatively engaged within a bore formed in said rotor, first hydraulic duct means extending through said stator, second hydraulic duct means extending through said rotor, passage means defined between said stator shaft and said rotor bore for placing said first and second hydraulic duct means in operative communication with each other, said first and said second hydraulic duct means being adapted to be operatively connected with hydraulic drive means for actuating said grab bucket, first and second shoulder means defined on said stator shaft axially spaced from each other and protruding radially therefrom, third and fourth shoulder means defined on said rotor arranged in cooperative relationship, respectively, with said first and second shoulder means on said stator shaft, first axial-radial bearing means operatively interposed between said stator shaft and said rotor axially located between said first and third shoulder means and second axial-radial bearing means operatively interposed between said stator shaft and said rotor axially located between said second and said fourth shoulder means, said passage means being axially located relative to said stator shaft between said first and said second axial-radial bearing means.

Thus, in accordance with the solution provided by the present invention, the stator shaft is formed at its upper and lower ends with annular shoulders each of which cooperate with annular shoulders of the rotor to support an axial-radial bearing within the region bounded by the adjoining annular shoulders. The annular shoulders of the shaft are arranged at axially separate parts of the stator which are nonrotatively connected with each other with radial circular passages being provided between the two bearings arranged in a region which may be free of sliding friction. The two bearings located at opposite ends of the stator shaft undertake the entire axial and radial support of the rotor in the stator so that no other bearings are required outside of this region. This considerably simplifies the construction of the mechanism and permits a modular construction of the rotating mechanism with a suitable driving mechanism, a brake or the like. The rotational mechanism can also be used for simple manual operations without these additional devices. No sliding friction occurs in the region of the circular passages so that an especially reliable operation with limited wear is ensured. The two-part construction of the stator simplifies the assembly and permits bracing in the two bearings.

In accordance with a preferred embodiment of the invention, the two bearings are constructed as roller bearings, especially conical roller bearings braced with respect to each other and having axially and radially supported ball races. Due to this mutual bracing of the bearings, an axial and radial play within the rotational mechanism is prevented and the susceptibility to wear is further reduced.

In accordance with a further aspect of the invention, especially favorable force transmission characteristics may be established between the rotor and the stator during radial and axial load application against the grab bucket by forming the rotor at the level of the upper bearing member with an outwardly protruding flange which is used for attachment of a bracing tube for the grab bucket which may be pushed from the bottom over the rotor. These measures also result in a considerable reduction of the structural height of the grab bucket arrangement including the rotating mechanism. The bracing tube forms, in this aspect of the invention, a type of housing for the rotating mechanism and protects it against outside influences.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
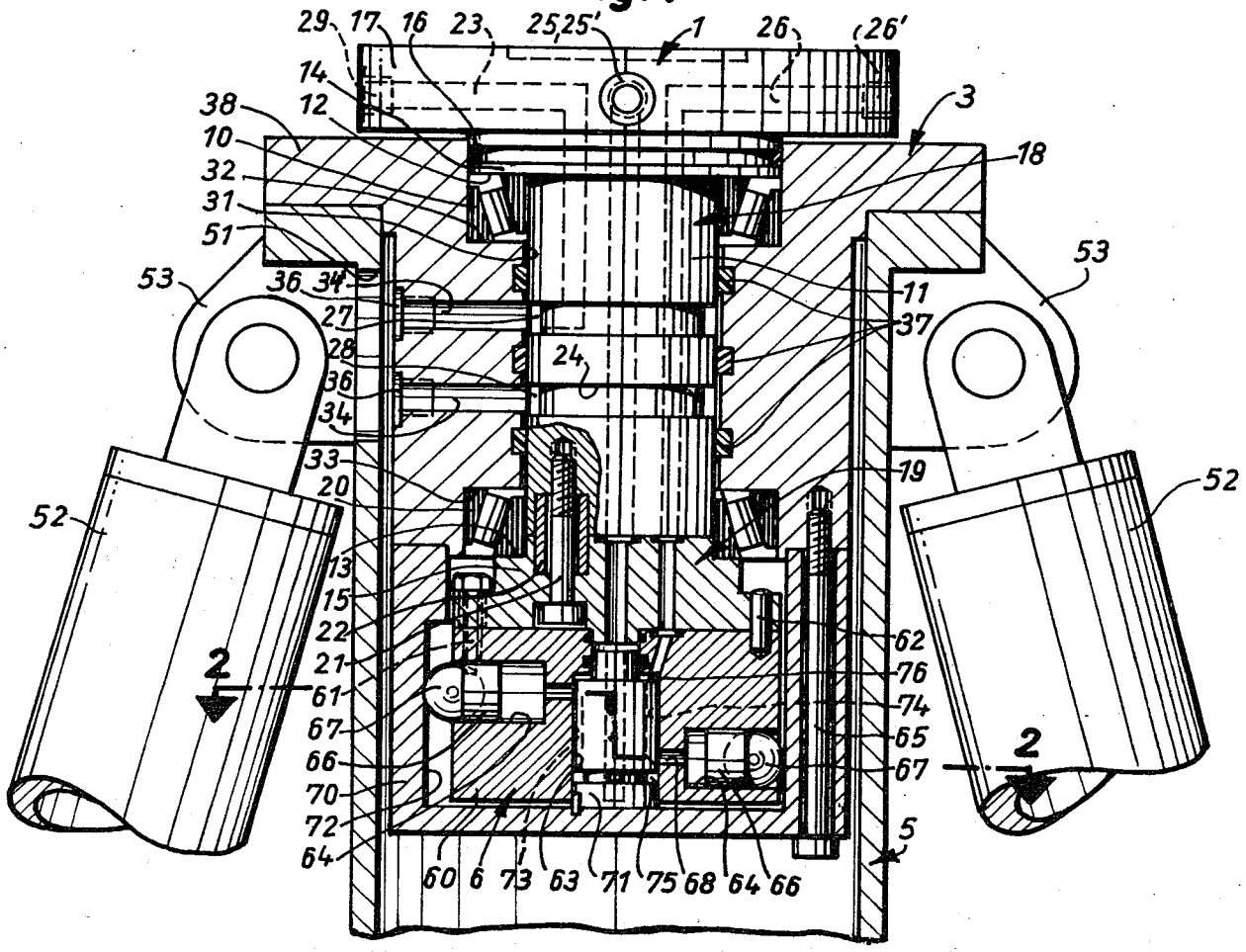
FIG. 1 is a sectional view showing a mechanism in accordance with the present invention for turning an excavator grab bucket with a hydraulic motor, the view of FIG. 1 being taken along the line 1—1 of FIG. 2.
Figure 2:
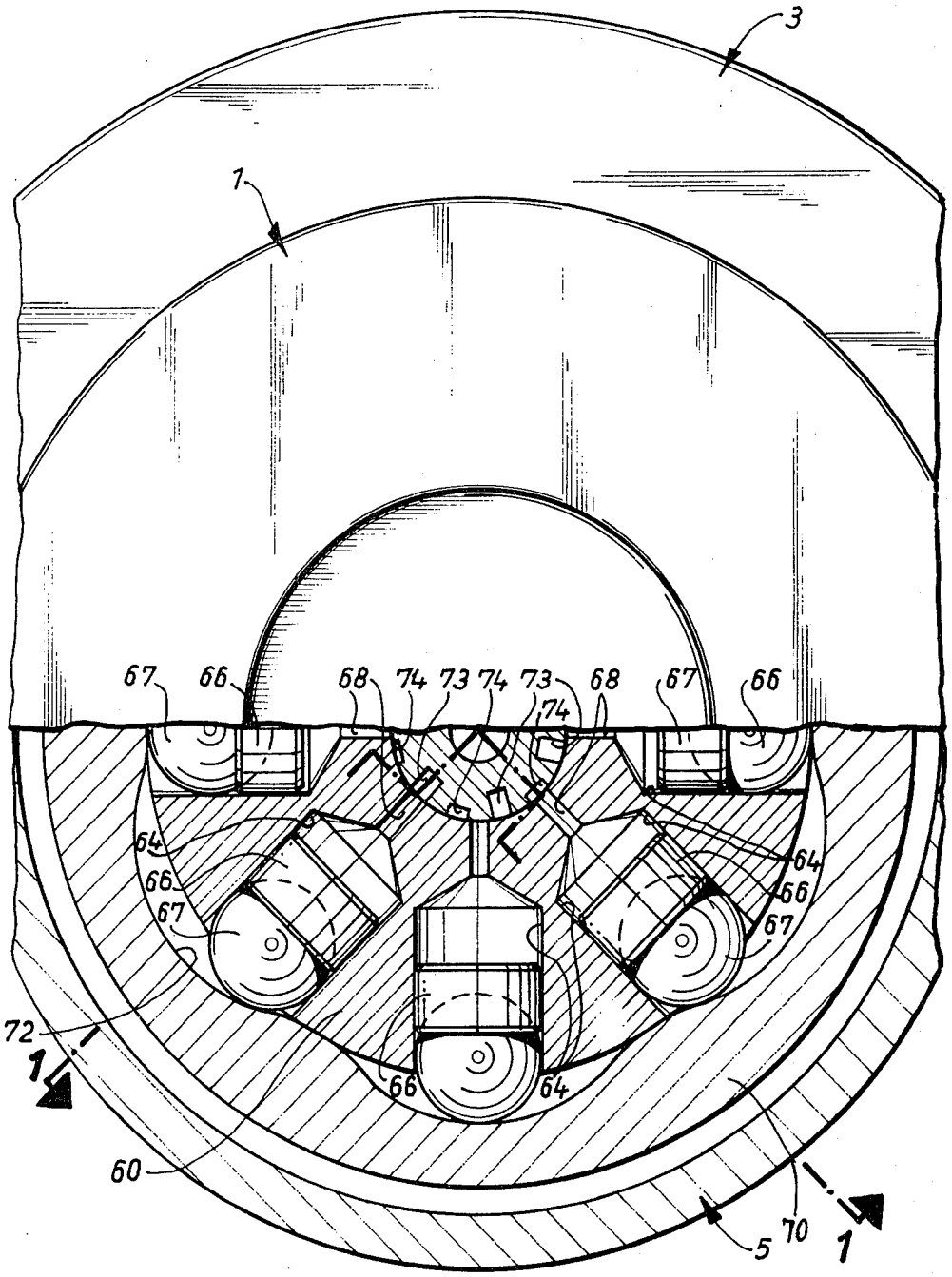
FIG. 2 is a sectional view partially broken away taken along the line 2—2 of FIG. 1.

As depicted particularly in FIGS. 1 and 2, the turning mechanism in accordance with the present invention essentially comprises a stator 1 which may be connected with a boom (not shown) of an excavator. The mechanism also includes a rotor 3 which is supported at the stator 1 and which is rotatable relative thereto about an axis which is usually vertical, with the rotor 3 being connected with a bracing tube 5 of an excavator grab bucket (not shown).

The stator 1 includes a cylindrical shaft 11 arranged in a bore 31 of the rotor 3. The shaft 11 is bound at the top and bottom thereof by collars 14 and 15, each of which form, respectively, an annular shoulder 12 and 13. In the region of the collars 14 and 15, the bore of the rotor 3 is widened and is configured to form an annular shoulder 32 or 33 cooperating, respectively, with each of the shoulders 12 and 13 so that between the stator and the rotor annular spaces are provided to receive therein axially and radially supported conical roller bearings 10 and 20.

The upper bearing 10 is sealed relative to the exterior of the turning mechanism by means of a gasket ring 16 arranged in a circumferential groove of the collar 14.

A flange 17 of the stator 1 adjoins the collar 14 and protrudes radially over the body of the rotor 3. This flange can be attached at the excavator boom.

The stator 1 is composed of two rotary parts 18 and 19 which may be constructed separately and which are rigidly connected with each other by means of screws 21. Axial and radial bracing of the conical roller bearings 10 and 20 is achieved with the screws so that any play within the turning mechanism will be prevented. Torque which may be effective between the two stator parts 18 and 19 is transmitted therebetween by sleeves 22 through which the screws 21 extend.

The mechanism of the invention is provided with four hydraulic ducts 23, 24, 25, and 26 which extend through the stator 1 beginning at a peripheral area of the flange 17. Two of the ducts 23 and 24 are each connected by means of one of a pair of circular passages 27 and 28 with corresponding ducts 34, 34' formed in the rotor. The circular passages 27 and 28 are located in the region of the separating surface between the stator shaft and the rotor bore. The ducts 34, 34' may be connected at connections 29 and 36 with hydraulic lines for actuation of the excavator grab bucket.

The circular passages 27 and 28 are sealed with respect to each other and with respect to the exterior of the turning mechanism by means of resilient gasket rings 37. In the region of the separating surface between the shaft 11 and the inner surface of the bore 31, a certain distance is observed by means of the two bearings 10 and 20 so that sliding friction is prevented.

It should be noted that the circular passages 27 and 28, which interconnect the hydraulic ducts in the stator with the hydraulic ducts in the rotor, are axially located between the bearings 10 and 20 and also between the shoulders on the stator and the rotor between which the bearings 10 and 20 are located.

In the proximity of the upper bearing 10, the rotor 3 is formed with an outwardly protruding flange 38 at which the bracing tube 5 may be connected. The bracing tube 5 for the excavator grab bucket is pushed from the bottom over the circular passage. Thus, there is achieved a relatively small structural height for the grab bucket arrangement and, on the other hand in the case of axial and radial percussions on the grab bucket, there is achieved an advantageous flow of force over the upper pivot bearing 10 to the stator flange 17 while preventing greater moment loads within the turning mechanism.

In the region of the bracing tube 5 there is an opening 51 for passage of the hydraulic lines for actuation of the grab bucket. The grab bucket is actuated by means of hydraulic cylinders 52 which are hinged at support eyes 53 arranged in the upper region of the bracing tube 5.

In the embodiment depicted in FIGS. 1 and 2, the turning mechanism may be driven by means of a hydraulic motor 6 which is constructed as a motor with balls, the motor being comprised of a cylindrical drum 60 rigidly connected with the lower stator part 19 by means of screws 61 and pins 62. The motor includes a curved housing 70 engaging around the cylindrical drum and connected with the rotor by means of screws 65 as well as a distributor 71 arranged to float in a bore 63 of the cylindrical drum and connected without rotation with the curved housing 70. The so-called floating arrangement of the distributor means that the distributor has radial and axial play. Therefore, the distributor can easily evade transverse forces and axial forces so that only relatively small bearing forces are exerted on the walls of the bore.

In the cylindrical drum 60 there are a plurality of radial pressure cylinders 64 uniformly spaced in the circumferential direction wherein one piston 66 and one ball 67 in contact with the end face of the piston 66 and engaging more or less far through a cylinder opening are arranged. The pistons are acted upon at the back with hydraulic liquid which enters through a bore 68 into the pressure cylinder. The balls 67 protrude from the cylinder opening and engage against an undulating inner surface 72 of a housing 70. The balls 67 are revolved in the circumferential direction and are deflected radially. The undulating surface 72 determines at any point in time the stroke of the piston 66.

When one ball 67 is pressed by the corresponding piston 66 by means of hydraulic liquid with a certain radial force against the inner surface of the curved housing 70, it then exercises, depending on the magnitude and direction of the inclination of the curved path 72 at the respective contact points, a more or less great torque in one or the other rotational direction of the rotor 3. In order to be able to put the rotor into rotary motion, the balls 67 must transfer torque acting in the same direction on the curved housing 70 and consequently on the rotor 3. Therefore, only those cylinders 64 may be acted upon with pressure whose balls 67 rest against a flank of the curved surface 72 which is directed outwardly opposite the rotational direction.

During rotation of the curved housing, these balls 67 move under the effect of the high pressure in the cylinders connected with the inlet line radially outwardly on the curved path 72 until the outer dead center is reached. The respective pressure cylinders 64 fill at the same time with hydraulic liquid. All those pressure cylinders 64 whose balls 67 rest against a flank of the curved path 72, directed inwardly opposite the rotational direction, however, must be connected with the return flow line which is under low pressure, so that the respective balls during movement of the curved path can be moved radially inwardly without a great expenditure of force and the hydraulic liquid can be pushed out of the respective pressure cylinder 64 into the return flow line. When a dead center of the stroke movement has been reached, the existing connection of the respective pressure cylinder 64 with the inlet or return flow line is interrupted and during the continued movement a connection with the other hydraulic line is produced.

The distributor 71 undertakes the control, in phases with respect to the curved path 72, of connecting the individual pressure cylinder 64 with the inlet and return flow lines. The distributor is connected without rotation with the curved housing 70 by means of a joggle joint. The distributor 71 has for this purpose a number of axial grooves which have a constant distance from each other in the circumferential direction and which form, together with the inner surface of the bore 63 of the cylinder drum 60, one slotted duct 73, 74. The slotted ducts 73 are connected by means of an annular duct 75 with the central hydraulic duct 25 in the stator, while the slotted ducts 74, which are always arranged between two slotted ducts 73, are connected by means of an annular duct 76 with the eccentrically arranged hydraulic duct 26 in the stator. The inlet and return flow lines, located outside of the turning mechanism, are connected to the connections 25' or 26' in the stator flange 17.

Figure 3:
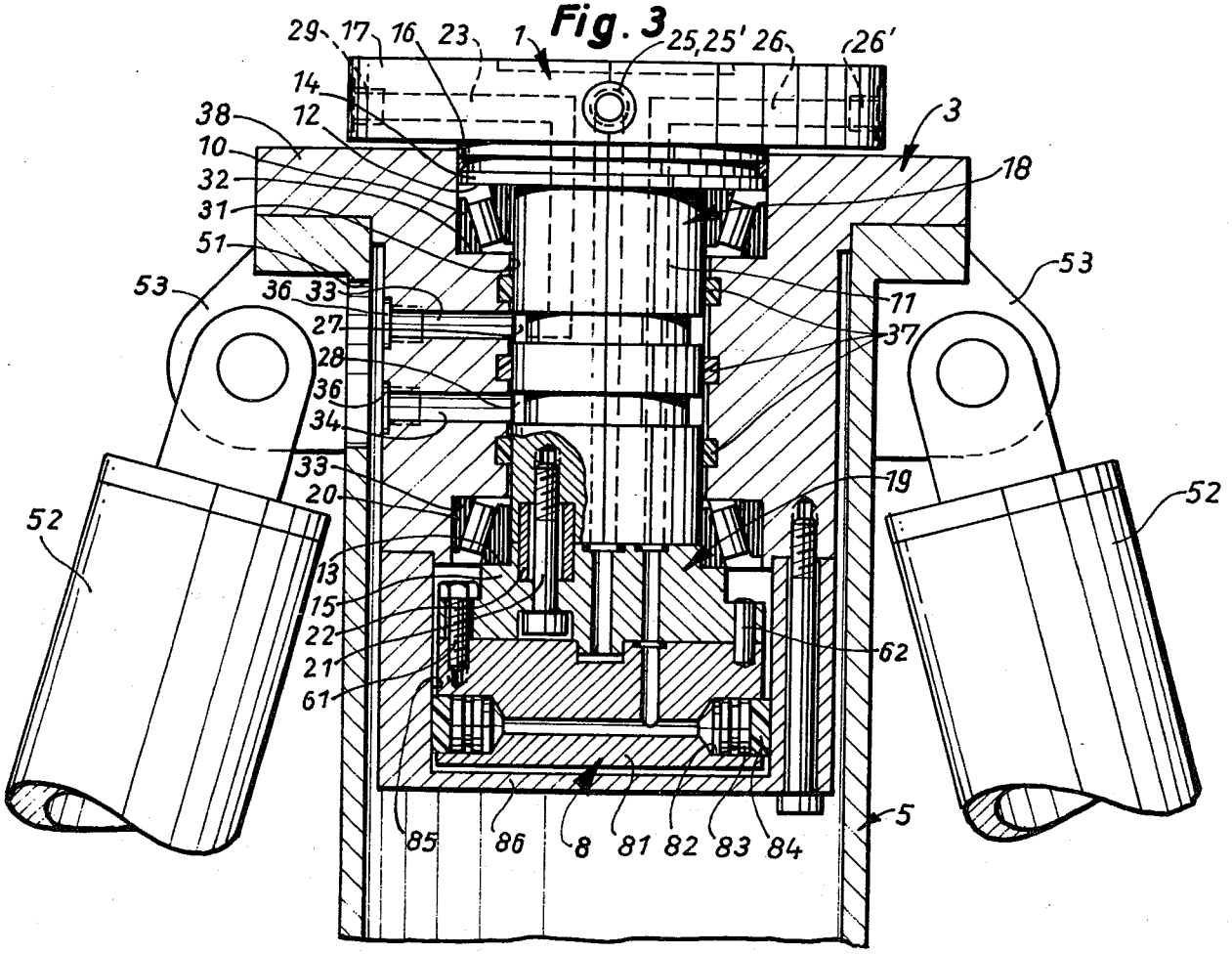
FIG. 3 is a sectional view taken through a turning mechanism in accordance with the present invention which is manually controllable and which includes a hydraulic brake.

In the embodiment depicted in FIG. 3, the turning mechanism is provided with a hydraulic brake 8 by means of which rotary movement of the rotor 3 may be braked. Rotary movement of the rotor 3 may be undertaken manually and the hydraulic brake is constructed as a piston brake having a cylindrical drum 81 attached by means of screws 61 and pins 62 to the bottom stator part 19. The cylindrical drum contains a plurality of pistons 83 which are radially movable in cylinders 82. The pistons 83 which may be acted upon with hydraulic liquid by means of the hydraulic duct 26 can be pressed by means of the brake linings 84 against the cylindrical inner surface 85 of the brake housing 86 connected with the rotor 3. Control of the brake preferably occurs by means of the hydraulic system for actuation of the grab bucket so that in the case of actuation of the grab bucket automatically any possible rotation of the rotor 3 is braked.

The actual turning mechanism with the circular passages 27 and 28 for actuation of the grab bucket may in the simplest case also be used without the hydraulic motor 6 or the hydraulic brake 8 if the motor drive or automatic braking of the rotary motion is not important. In this case the hydraulic ducts 25, 26 have no function and can be closed from the exterior.

While specific embodiments of the invention have been shown and described in detail to illustrate the application of the inventive principles, it will be understood that the invention may be embodied otherwise without departing from such principles.

What is claimed is:

1. Apparatus for actuating a grab bucket of an excavator comprising: a stator mounted on said excavator; a rotor having said grab bucket mounted thereon connected with said stator for rotation relative thereto about a rotational axis; a shaft on said stator operatively engaged within a bore formed in said rotor; first hydraulic duct means extending through said stator; second hydraulic duct means extending through said rotor; passage means defined between said stator shaft and said rotor bore for placing said first and second hydraulic duct means in operative communication with each other; said first and said second hydraulic duct means being adapted to be operatively connected with hydraulic drive means for actuation of said grab bucket; first and second shoulder means defined on said stator shaft axially spaced from each other and protruding radially therefrom; third and fourth shoulder means defined on said rotor arranged in cooperative relationship, respectively, with said first and second shoulder means of said stator shaft; first axial-radial bearing means operatively interposed between said stator shaft and said rotor axially located between said first and third shoulder means; and second axial-radial bearing means operatively interposed between said stator shaft and said rotor axially located between said second and fourth shoulder means; said passage means being axially located relative to said stator shaft between said first and said second axial-radial bearing means.

2. Apparatus according to claim 1 wherein said first and second shoulder means comprise an upper and a lower annular shoulder of said stator, with said upper annular shoulder of said stator being arranged at a part of said shaft having said passage means.

3. Apparatus according to claims 1 or 2 wherein said first and said second bearing means comprise conical roller bearings braced with respect to each other and having axially and radially supported ball races.

4. Apparatus according to claim 2 wherein said upper annular shoulder of said stator is formed by a collar, said collar having a circumferential groove formed therein to receive a gasket ring sealing said first bearing means relative to the exterior of said apparatus and resting against a cylindrical inner surface of said rotor.

5. Apparatus according to claim 1 wherein said rotor is formed with an outwardly protruding flange located at a level generally coincident with one of said first and second bearing means, said flange having attached thereto a bracing tube movable over said rotor from the bottom thereof for connection with said grab bucket.

6. Apparatus according to claim 1 wherein said rotor at a part thereof containing said circular passages is rigidly connected with a cup-shaped housing forming a motor with balls, said housing being constructed as a curved housing adapted to receive a cylindrical drum rigidly connected with the bottom part of said stator and containing a number of radially arranged balls acting against the inner surface of said housing forming a curved path, said cylindrical drum having cylinders acted upon with hydraulic liquid, with a distributor being arranged to float in a bore of said cylindrical drum connected without rotation with said rotor controlling the hydraulic connection of said second hydraulic duct means to said cylinders wherein said cylindrical drum is arranged in said housing without bearings.

7. Apparatus according to claim 6 wherein said cylindrical drum is adapted when said curved housing is removed to be connected by means of screws accessible radially from the outside with said stator.

8. Apparatus according to claim 1 wherein said rotor is rigidly connected at a bottom portion thereof with a cup-shaped housing, wherein said housing contains a hydraulically operable brake functioning between said stator and said rotor.

9. Apparatus according to claim 8 wherein said brake may be activated by means of a hydraulic system operable for actuation of said grab bucket.

10. Apparatus according to claim 1 wherein said first hydraulic duct means are adapted to be closed from the exterior of said turning mechanism.

11. Apparatus according to claim 5 wherein said bracing tube is formed with a wall opening for passage therethrough of hydraulic lines for actuation of said grab bucket.

* * * * *